US008807114B2

(12) United States Patent
Itakura

(10) Patent No.: US 8,807,114 B2
(45) Date of Patent: Aug. 19, 2014

(54) ACCESSORY MOUNTING STRUCTURE FOR INTERNAL COMBUSTION ENGINE

(71) Applicant: Honda Motor Co., Ltd., Tokyo (JP)

(72) Inventor: Jun Itakura, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 13/669,281

(22) Filed: Nov. 5, 2012

(65) Prior Publication Data

US 2013/0125856 A1 May 23, 2013

(30) Foreign Application Priority Data

Nov. 18, 2011 (JP) ..... 2011-252709

(51) Int. Cl.

| | |
|---|---|
| ***F02B 67/06*** | (2006.01) |
| ***F01P 5/10*** | (2006.01) |
| ***F02B 67/00*** | (2006.01) |
| *F02B 61/04* | (2006.01) |
| *F01L 1/00* | (2006.01) |
| *F02B 75/22* | (2006.01) |
| *F02B 67/04* | (2006.01) |

(52) U.S. Cl.

CPC ..... *F01P 5/10* (2013.01); *F02B 61/045* (2013.01); *F01L 1/00* (2013.01); *F02B 67/06* (2013.01); *F02B 67/00* (2013.01); *F02B 75/22* (2013.01); *F02B 67/04* (2013.01)

USPC ..... 123/198 R

(58) Field of Classification Search

CPC ..... F02B 67/06; F02B 75/22; F02B 67/04; F02B 61/045

USPC ..... 123/198 R

See application file for complete search history.

(56) References Cited

U.S. PATENT DOCUMENTS

| | | | | |
|---|---|---|---|---|
| 6,422,195 | B1 * | 7/2002 | Powell | 123/198 C |
| 7,194,994 | B1 * | 3/2007 | Chisenhall et al. | 123/195 A |
| 2002/0050263 | A1 * | 5/2002 | Asano et al. | 123/195 R |

FOREIGN PATENT DOCUMENTS

| | | | |
|---|---|---|---|
| JP | 11-294180 | A | 10/1999 |
| JP | 2002-174126 | A | 6/2002 |
| JP | 2009-156156 | A | 7/2009 |

OTHER PUBLICATIONS

Japanese Office Action, Application No. 2011-252709 dated Jul. 16, 2013.

* cited by examiner

*Primary Examiner* — Lindsay Low
*Assistant Examiner* — Charles Brauch
(74) *Attorney, Agent, or Firm* — Arent Fox LLP

(57) ABSTRACT

In an accessory mounting structure for an internal combustion engine, an accessory unit block detachably supporting an engine accessory is attached to the side of the body of the engine. The accessory unit block has an upper portion of a flat shape, and a lower portion extending away from the engine body to terminate in a water pump housing. An upper fixing boss is formed on an upper part of the upper portion, while a lower fixing boss is formed on an end, remote from the engine body, of an upper-side edge of the water pump housing. The engine accessory is fixedly mounted on the unit block by attaching fixing brackets to the upper and lower fixing bosses. The engine accessory is thus compactly accommodated.

7 Claims, 8 Drawing Sheets

ACCESSORY MOUNTING STRUCTURE FOR INTERNAL COMBUSTION ENGINE

BACKGROUND OF THE INVENTION

1. Field of the Invention

The present invention relates to an accessory mounting structure for an internal combustion engine, and more particularly to a structure for mounting an accessory or an auxiliary machine for an internal combustion engine.

2. Description of the Related Art

Various structures for supporting accessories on the body of an engine are proposed to mount the accessories to the engine body through a mounting bracket or the like (see, for example, JP 3,342,398B).

JP 3,342,398B discloses an accessory mounting structure for mounting accessories by means of an accessory mounting bracket, in which the accessories such as an alternator (AC generator), a compressor and so on are supported on the accessory mounting bracket (accessory unit block) attached to a side of an internal combustion engine.

The accessory mounting bracket is formed with a water pump housing which constitutes a water pump as an engine accessory, and a cooling water discharge passage extends upward from the water pump housing for cooling water discharged from the water pump. An alternator is mounted on a side of a portion of the accessory mounting bracket in which the cooling water discharge passage is formed.

The cooling water discharge as sage extending upward from the water pump housing is of a broad width, while the accessory mounting bracket portion forming the cooling water discharge passage therein also has a broad width which is substantially equal to the diameter of the concave interior space of the water pump housing. Therefore, the alternator which is attached to the side of the accessory mounting bracket portion is positioned apart from the engine body through the broad-width accessory mounting bracket portion interposed between the engine body and the alternator. Consequently, the alternator is largely separated from the engine body and protrudes sidewise of the water pump, so that the volumetric space occupied by the entire engine assembly is made large.

Further, the alternator having a cylindrical housing is attached to the substantially planar side surface of the accessory mounting bracket portion which extends upward with substantially the same width as the water pump housing. Therefore, the alternator is naturally protruded sidewise of the engine body, and it is difficult to secure a sufficient strength for mounting the alternator to the accessory mounting bracket.

Since most of the engine accessories including the alternator are rotary machines and have cylindrical housings, engine accessories other than the alternator also tend to protrude sidewise to a large extent from the engine body.

The present invention is made in view of the foregoing and the object of the present invention is to provide an accessory mounting structure for an internal combustion engine in which any engine accessories do not protrude to a large extent from the engine body and in which the engine accessories are arranged along the engine body in a compact manner to provide a small-sized engine assembly.

SUMMARY OF THE INVENTION

According to the present invention, there is provided an accessory mounting structure for an internal combustion engine including an accessory unit block supporting an engine accessory, the unit block being detachably attached to a side of the body of the internal combustion engine: wherein the accessory unit block comprises: an upper portion having a flat shape extending along the side of the engine body and including a cooling water supply part communicating with a cooling water inlet in the engine body, a middle portion extending in a curved shape from a lower part of the upper portion in a direction away from the engine body, and a lower portion extending downward from the middle portion and further away from the engine body and disposed more remote from the engine body than the upper portion, the lower portion integrally having a water pump housing defining a pump chamber and a thermostat housing enclosing a thermostat; wherein the accessory unit block is formed therein with a cooling water discharge passage extending from the pump chamber in the water pump housing through the curved middle portion and the upper portion into the cooling water supply part of the accessory unit block, and the accessory unit block includes an upper fixing boss formed on an upper part of the upper portion of the unit block, and a lower fixing boss formed on an end of an upper-side edge of the water pump housing of the lower portion, the upper-side edge extending away from the engine body; and wherein the engine accessory is formed with fixing brackets attached and fixed to the upper and lower fixing bosses of the unit block, respectively, and the engine accessory is fixedly mounted on the unit block by means of the fixing brackets.

In a preferred embodiment of the invention, the upper portion, the middle portion and the lower portion of the accessory unit block are shaped to form an L-shaped recessed space in which the engine accessory is accommodated.

According to a preferred embodiment of the invention, the accessory unit block includes a first attachment surface attached to the side of the engine body, and a second attachment surface extending from the upper portion to the lower portion of the unit block and extending perpendicular to the first attachment surface, a water pump cover is attached to the second attachment surface, the water pump housing has an opening formed in the second attachment surface belonging to the lower portion, and a water pump is assembled with the accessory unit block to cover the opening of the water pump housing.

Preferably, the upper portion of the unit block includes cover-fixing parts formed on the second attachment surface adjacent to the upper fixing boss, the lower portion of the unit block includes cover-fixing parts formed on the second attachment surface adjacent to the lower fixing boss, the water pump cover is formed with attachment parts, and the water pump cover is attached to the unit block by fixing the attachment parts of the water pump cover to the cover-fixing parts of the upper and lower portions.

According to a further preferred embodiment of the invention, the cooling water discharge passage is defined by a recessed passage formed in the unit block along the second attachment surface extending from the upper portion to the lower portion through the middle portion (42).

Preferably, a line passing through the upper fixing boss and the center of the engine accessory and a line passing through the lower fixing boss and the center of the engine accessory cross at an obtuse angle.

According to the present invention, the accessory unit block attached to the side of the engine body is made up of an upper portion having a flat shape extending along the side of the engine body, a middle portion extending in a curved shape in a direction away from the engine body, and a lower portion extending downward from the middle portion and further away from the engine body and disposed more remote from the engine body than the upper portion, the lower portion integrally having a water pump housing defining a pump chamber and a thermostat housing enclosing a thermostat. Thus, the upper portion of a flat shape and the upper edge of the lower portion extending away from the engine body form substantially an L-shape to define a recessed space in which the accessory unit block is accommodated. For this reason, the engine accessory can be disposed in the recessed space above the lower portion incorporating the water pump and the thermostat and along the flat-shaped upper portion at a position close to the engine body. Consequently, the engine accessory is arranged in a compact manner along the engine body so that the volumetric size of the entire engine assembly can be reduced.

An upper fixing boss is formed on an upper part of the upper portion of the unit block, and a lower fixing boss is formed on an end of an upper-side edge of the water pump housing extending away from the engine body, while the engine accessory is mounted on the unit block by attaching fixing brackets of the engine accessory to the upper and lower fixing bosses of high rigidity and strength. Therefore, a sufficient rigidity for supporting the engine accessory is obtained.

Further, the engine accessory is attached in a manner to connect the upper fixing boss and the lower fixing boss, which are respectively at the two ends of the substantially L-shape formed by the upper portion and the upper-side edge of the lower portion of the unit block. For this reason, the accessory unit block itself is reinforced by the engine accessory.

According to a preferred embodiment of the invention, the water pump cover is attached to the attachment surface extending from the upper portion to the lower portion of the unit block by attaching the attachment parts of the water pump cover to cover-fixing parts of the upper and lower portions of the unit block, which cover-fixing parts are provided on the attachment surface adjacent to the upper and lower fixing bosses for fixing the accessory. Therefore, the accessory unit block is reinforced also by the water pump cover.

Since the upper and lower cover-fixing parts are positioned adjacent to the upper and lower fixing bosses for fixing the accessory, rigidity and strength of the upper and lower fixing bosses are increased and the support strength for the accessory is enhanced.

According to a preferred embodiment, the cooling water discharge passage is defined by a recessed passage formed in the unit block along the attachment surface extending from the upper portion to the lower portion through the middle portion. This enables easy working of the cooling water discharge passage.

The cooling water discharge passage is formed in an arcuate shape through the middle portion. This suppresses hydraulic loss in the flow passage. Further, the accessory is attached in a manner to stretch a chord between the two ends of an arc. Therefore, a required strength for the cooling water discharge passage can be maintained even in case the parts around the discharge passage are not made sophisticated, whereby the accessory unit block and the water pump cover can be made compact and of light weight.

DESCRIPTION OF THE PREFERRED EMBODIMENTS

A preferred embodiment of the accessory mounting structure for an internal combustion engine according to the present invention will be described with reference to the drawings.

Figure 1:
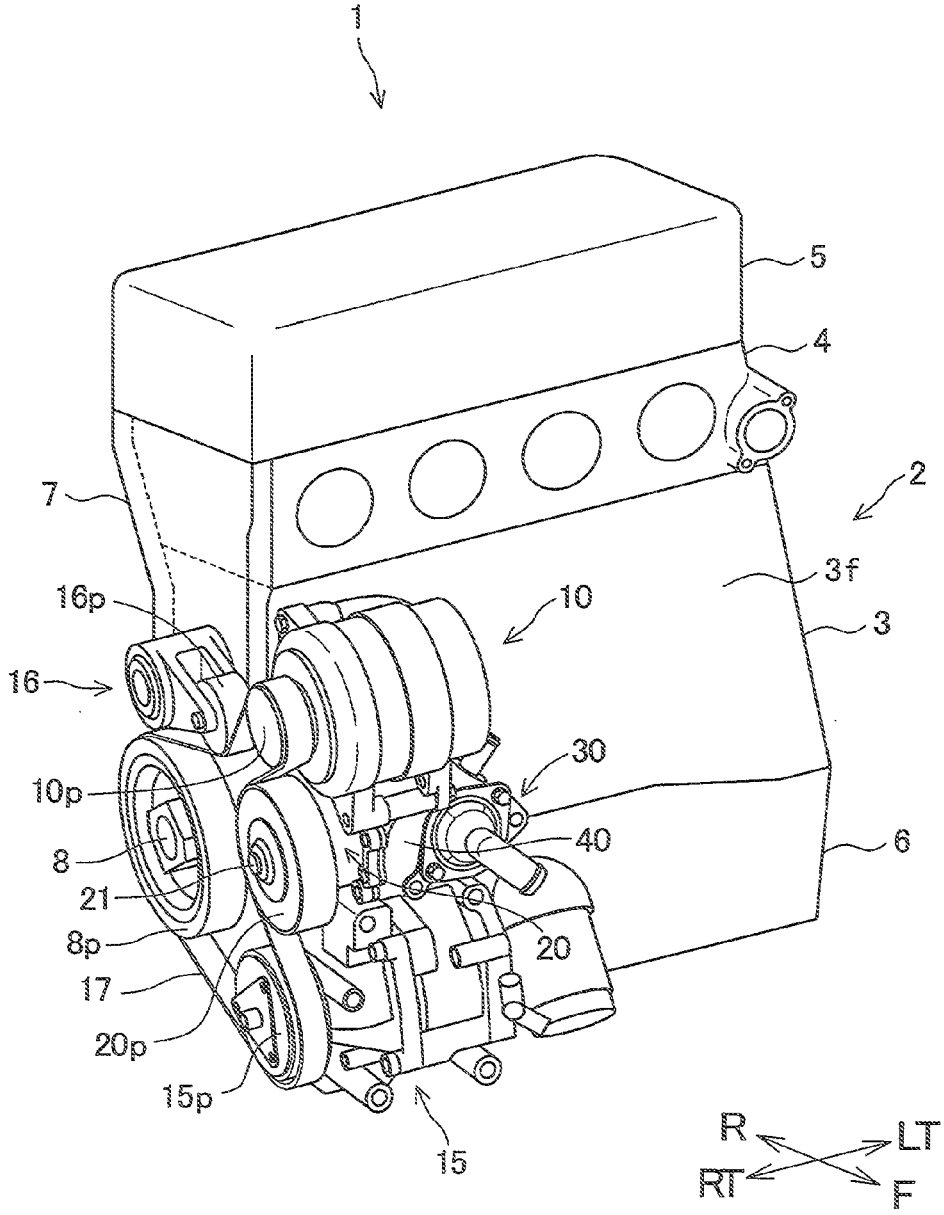
FIG. 1 is a perspective view of an internal combustion engine provided with an accessory mounting structure according to a preferred embodiment of the present invention.
Figure 2:
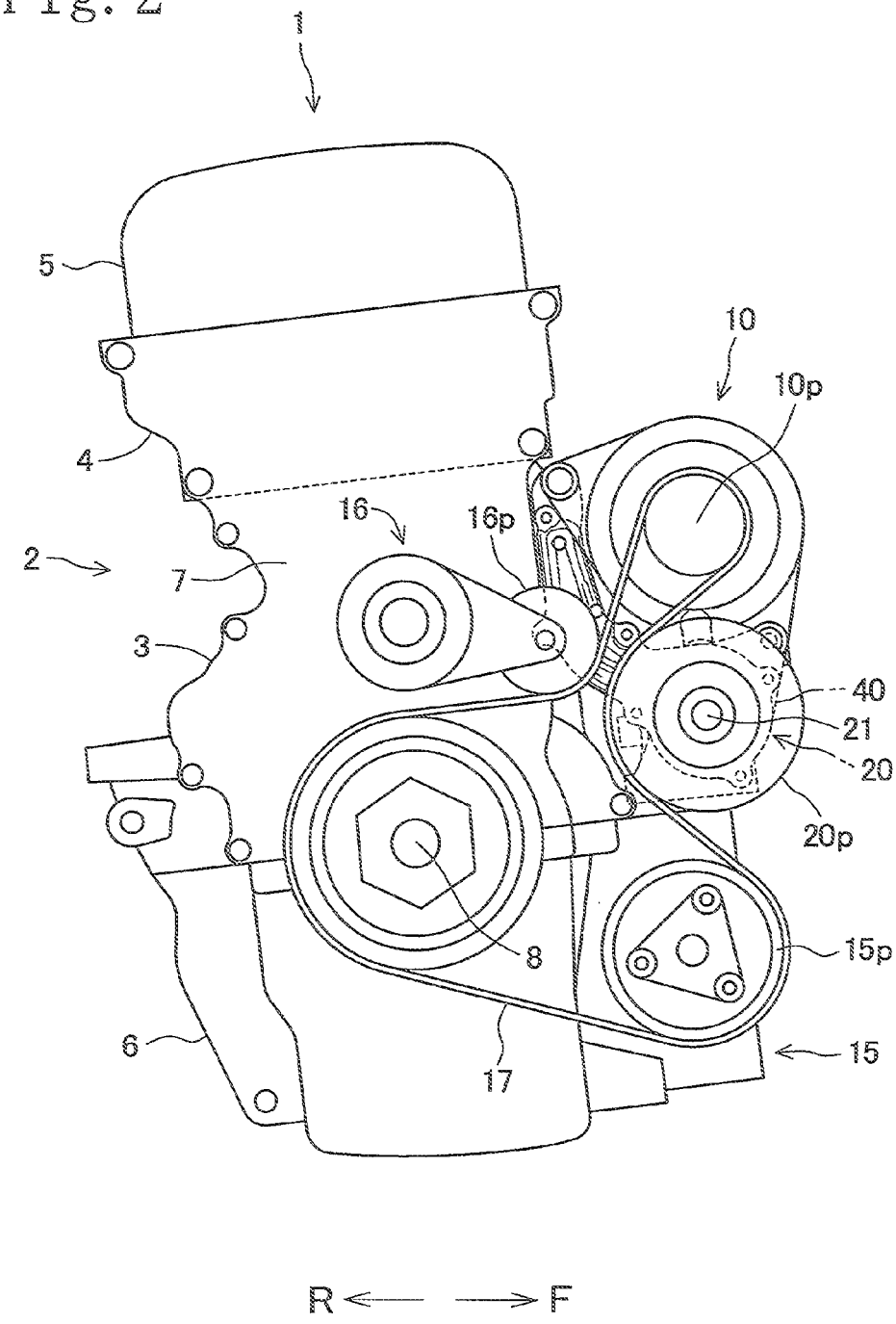
FIG. 2 is a side view of the same.

As shown in FIGS. 1 and 2, an internal combustion engine provided with the accessory mounting structure according to the present invention is designated by reference numeral 1 and is a 4-stroke water-cooled internal combustion engine with four cylinders arranged in a line. The engine is mounted on a vehicle with its crankshaft 8 oriented in a left-to-right direction (vehicle-width direction).

In the specification, the directions of front, rear, left and right are determined based on the vehicle. In the drawings, F indicates front, "rear, left", and RT "right", respectively.

The internal combustion engine 1 has an engine body 2, which is made up of a cylinder block 3 with its cylinders arranged in the vehicle-width direction, a cylinder head 4 mounted above the cylinder block 3, a cylinder head cover 5 mounted above the cylinder head 4, and an oil pan 6 provided below the cylinder block 3. A chain cover 7 is attached to the right sides of the cylinder block 3 and the cylinder head 4.

An AC generator (alternator) 10, a water pump 20 and a compressor 15, as engine accessories, are disposed from top to bottom in this order on a front side surface 3*f* of the engine body 2 and at positions toward the right-side portion of the engine body 2.

A crankshaft 8 extends through the chain cover 7 to the right side of the engine body 2, and a drive pulley 8*p* is fixed to the end of the crankshaft 8 penetrating the chain cover 7. A chain tensioner 16 is provided above the drive pulley 8*p*. The chain tensioner 16 has an idler pulley 16*p* supported on the free end of an arm which is urged to swing.

The AC generator 10 has a drive shaft projecting to the right, and a generator pulley 10*p* is fixed to the projecting end of the drive shaft. The water pump 20 has a pump drive shaft projecting to the right, and a water pump pulley 20*p* is fixed to the projecting end of the pump drive shaft. The compressor 15 has a compressor drive shaft projecting to the right, and a compressor pulley 15*p* is fixed to the projecting end of the compressor drive shaft. These generator pulley 10*p*, water pump pulley 20*p* and compressor pulley 15*p* are disposed on a same vertical plane on which the drive pulley 8*p* and the idler pulley 16*p* are disposed. An endless belt 17 is wound around the drive pulley 8*p*, idler pulley 16*p*, generator pulley 10*p*, water pump pulley 20*p*, and compressor pulley 15*p* in this order. When the drive pulley 8*p* rotates, the endless belt 17 is driven to cause the Ac generator 10, the water pump 20 and the compressor 15, as engine accessories, to be driven in rotation in unison.

Figure 3:
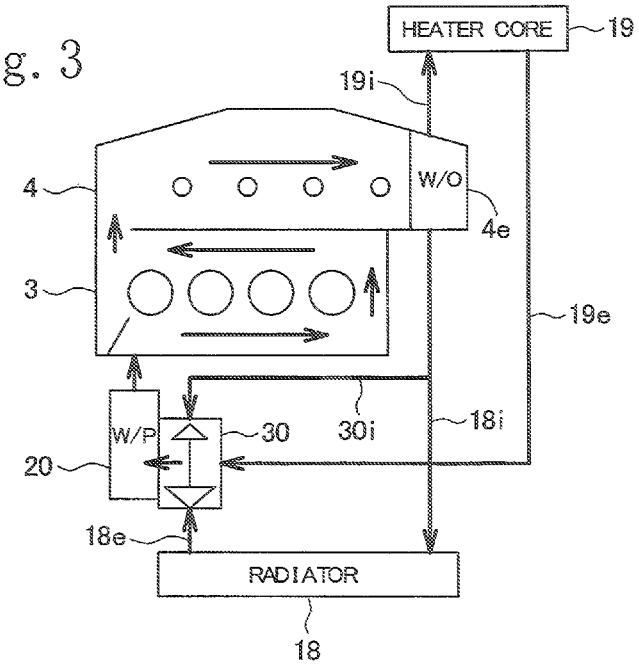
FIG. 3 is a schematic view of a cooling system of the internal combustion engine.

When the water pump 20 is operated, cooling water is circulated therefrom through a cooling system, which will be briefly explained with reference to the schematic view of FIG. 3.

Cooling water discharged from the water pump 20 first enters the cylinder block 3, being circulated through a water jacket in the cylinder block 3, and then enters the cylinder head 4, being circulated through a water jacket in the cylinder head 4, whereby heat exchange is carried out between the cooling water and both the cylinder block 3 and the cylinder head 4. The cooling water finally flows out through a water outlet 4*e*.

From the water outlet 4*e* extend a passage 18*i* leading to a radiator 18 and a bypass passage 30*i* leading to a thermostat 30. From the radiator 18 extends a passage 18*e* leading to the thermostat 30.

From the water outlet 4*e* extends a passage 19*i* leading to a heater core 19 of an air conditioner. A passage 19*e* is provided to connect the heater core 19 to the thermostat 30.

As will be described later, the thermostat 30 is assembled in an accessory unit block 40 together with the water pump 20, and circulating cooling water flows from within the thermostat 30 into the water pump 20.

The cooling system has the water circulation passages as outlined above.

In the cool time, the thermostat 30 closes the passage 18*e* from the radiator 18 and opens the passage 30*i* from the water outlet 4*e*, so that cooling water does not circulate through the radiator 18 but flows through only the cylinder block 3 and the cylinder head 4 to promote engine warming.

In the heated time, the thermostat 30 opens the passage 18*e* from the radiator 18 and closes the passage 30*i* from the water outlet 4*e*, so that cooling water whose heat has been removed by the radiator 18 flows through the cylinder block 3 and the cylinder head 4 to cool the same.

Figure 9:
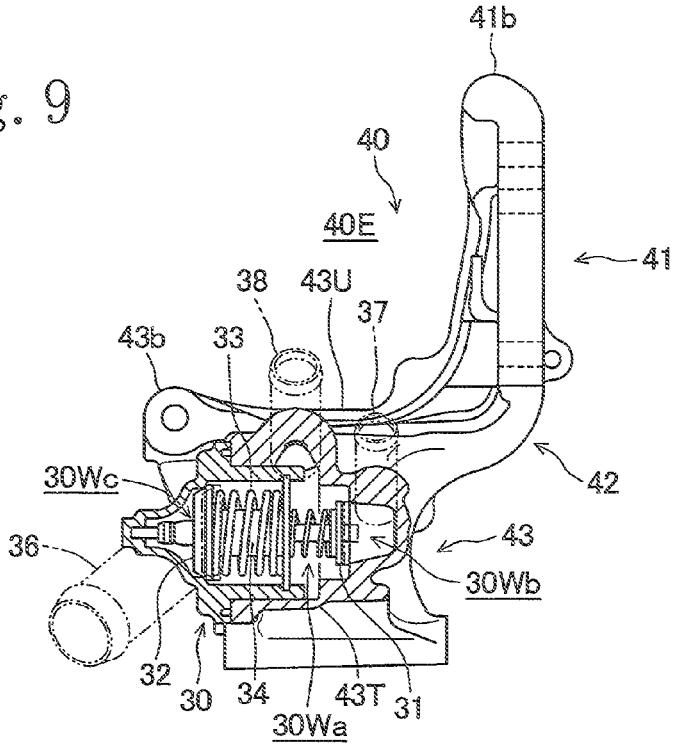
FIG. 9 is a sectional view showing a thermostat.

The cooling water flowing into the heater core 19 flows through the heater core 19 and the thermostat 30 back into the water pump 20 without being influenced by the operation of the thermostat 30 and without substantially influencing a wax 34 (FIG. 9). The cooling water flowing out of the heater core 19 circulates constantly into the water pump 20.

The compressor 15 as an engine accessory is attached to the oil pan 6, while the AC generator 10 as an engine accessory is supported on the cylinder block 3 via the accessory unit block 40 to which the water pump 20 and the thermostat 30 are assembled.

A structure for mounting the AC generator 10, together with the water pump 20 and the thermostat 30, will be described below.

Figure 11:
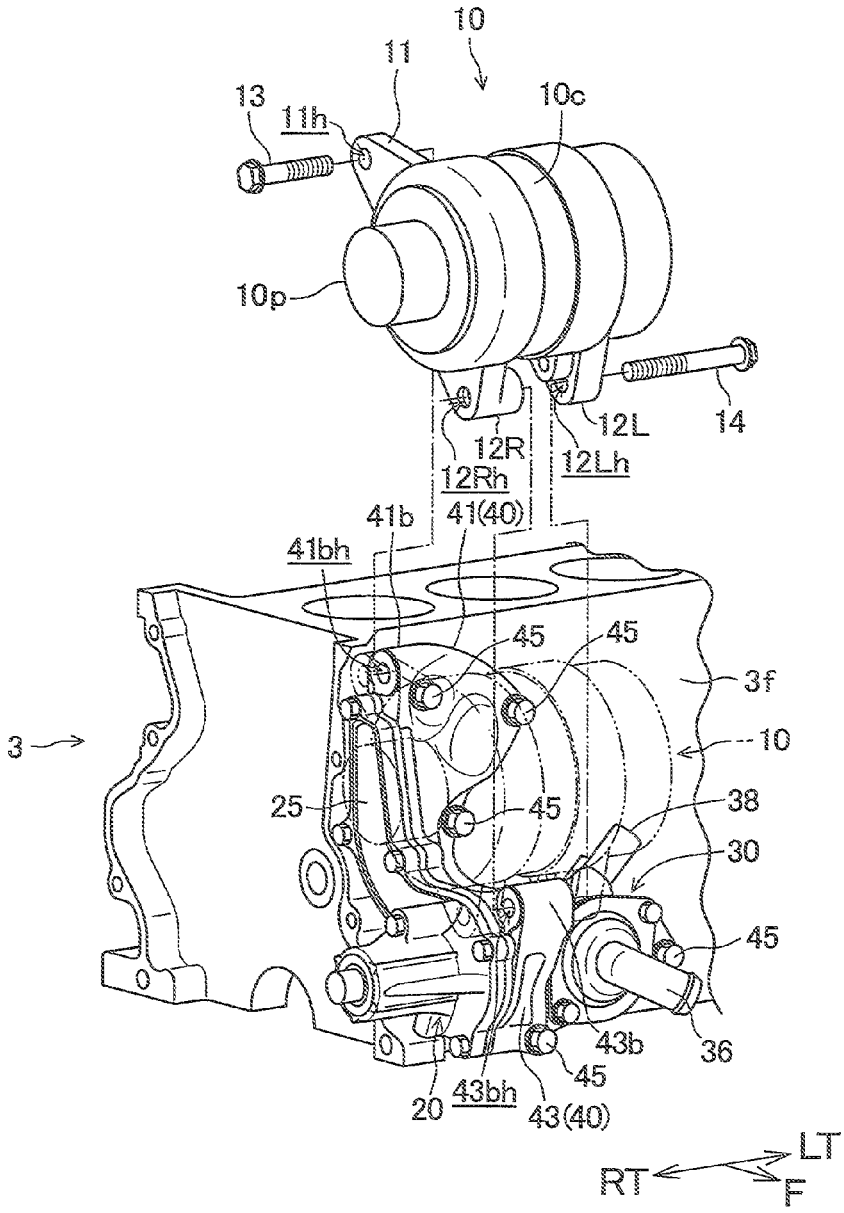
FIG. 11 is an exploded perspective view showing a state in which the accessory unit block assembled with the water pump and the thermostat is attached to a cylinder block and in which an AC generator is about to be mounted.
Figure 12:
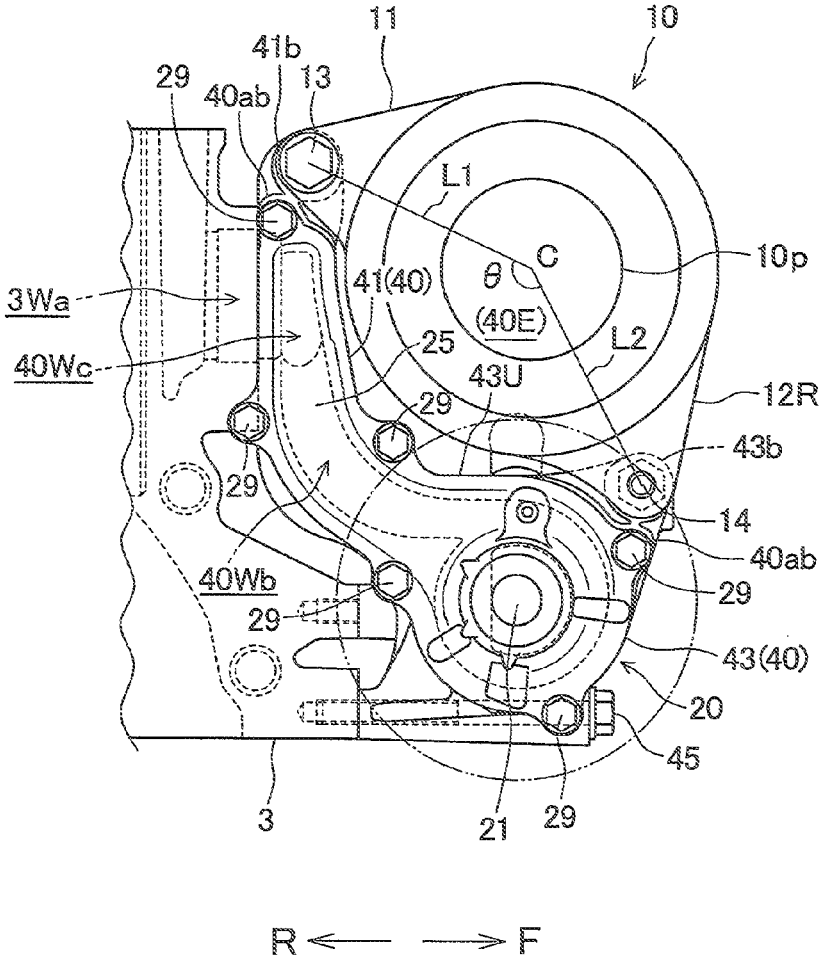
FIG. 12 is a right side view showing a state in which the AC generator is mounted on the accessory unit block attached to the cylinder block.

As indicated in FIGS. 11 and 12, the cylinder block 3, which is elongated in the direction (left-to-right direction) in which the cylinders are arranged, has its lower crankcase portion or lower half portion shaped to bulge to both the front and rear, so that the lower half portion has an enlarged width in the front-to-rear direction.

Figure 4:
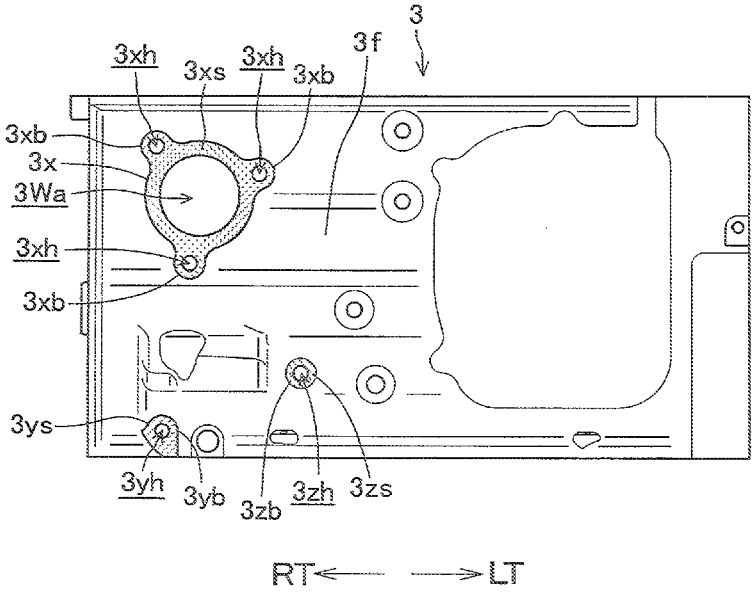
FIG. 4 is a front view of a cylinder block of the internal combustion engine.

As shown in FIG. 4, a cooling water inlet 3Wa is provided in a front side surface 3*f* of the cylinder block 3 and at an upper position toward the right side thereof. The cooling water inlet 3Wa has an annular end surface 3*x* serving as an attachment surface 3*xs*. The annular end surface 3*x* is provided with three circumferentially spaced-apart attachment bosses 3*xb* having attachment holes 3*xh*, respectively.

On the forwardly bulged portion of the lower part of the cylinder block 3 are formed two attachment bosses 3*yb* and 3*zb* positioned in an area toward the right-side part of the cylinder block 3. The attachment bosses 3*yb* and 3*zb* have attachment surfaces 3*ys* and 3*zs* formed with attachment holes 3*yh* and 3*zh*, respectively.

Figure 5:
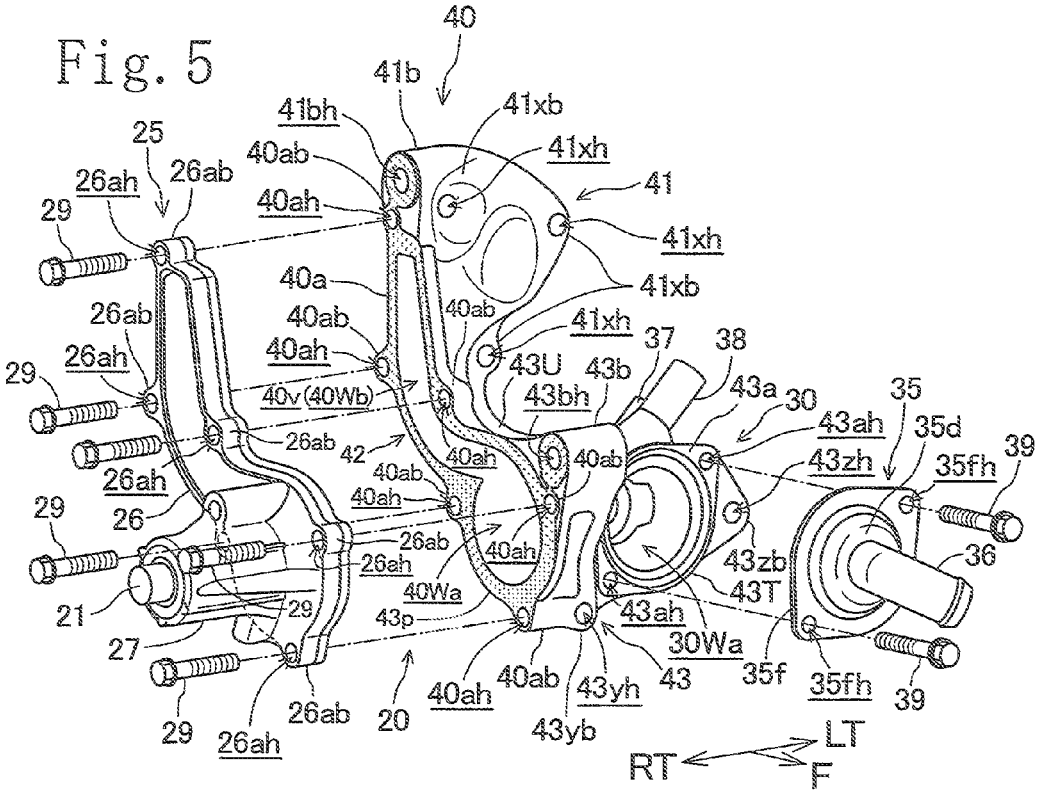
FIG. 5 is an exploded view showing an accessory unit block, a water pump cover and a thermostat cover.

As shown in FIG. 5 (FIGS. 6 and 7), the accessory unit block 40 to be securely attached to the front side surface 3*f* of the cylinder block 3 includes an upper portion 41 of a flat outer shape extending along the front side surface 3*f* of the cylinder block 3, a middle portion 42 extending in a curved outer shape from the lower end of the upper portion 41 away (forwardly) from the cylinder block 3 (engine body 2), and a lower portion 43 extending from the middle portion 42 further downward and forward. The lower portion 43 has a water pump housing 43P and a thermostat housing 43T, which are integrally formed with the lower portion 43 at positions farther displaced from the cylinder block 3 forwardly than the upper portion 41. The lower portion 43 is located forward of and along the forwardly bulged lower half portion of the cylinder block 3.

The accessory unit block 40 has a right side surface which is perpendicular to the rear surface of the accessory unit block 40, which rear surface is an attachment surface of the unit block 40, for attachment to the front side surface 3*f* of the cylinder block 3. The right side surface of the accessory unit block 40 is formed as an attachment surface 40*a* to which a water pump cover 25 is attached.

The lower portion 43 of the accessory unit block 40 is formed with the water pump housing 43P along the attachment surface 40*a*. The water pump housing 43P defines therein a pump chamber 40Wa in which impellers 43P (FIG. 10) of the water pump 20 is enclosed. The thermostat housing 43T for the thermostat 30 is integrally formed by a portion bulging to the left from the water pump housing 43P.

Figure 6:
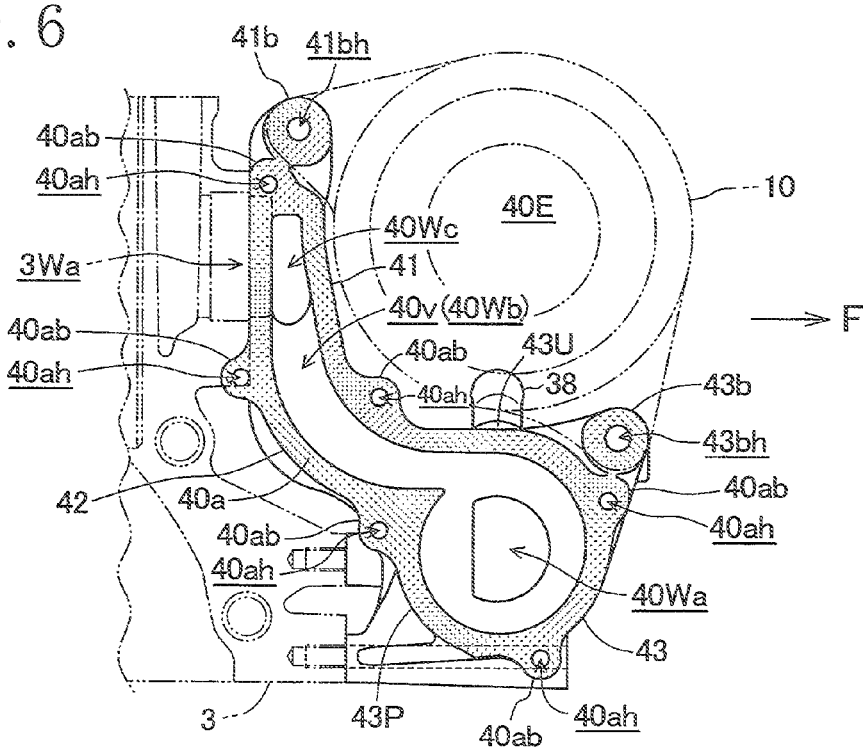
FIG. 6 is a right side view of the accessory unit bock.

As will be understood from FIG. 6 showing a right side view of the accessory unit block 40, the upper portion 41 of the flat outer shape, the middle portion 42 curved forward from the upper portion 41, and the lower portion 43 extending forward from the middle portion 42 form a substantially L-shape with the upper portion 41 extending vertically upward and with the lower portion 43 extending substantially horizontally and formed with an upper-side edge 43U. A space 40E of a recessed shape like the letter L is formed forward of the upper portion 41 and above the upper side edge 43U of the lower portion 43.

Figure 7:
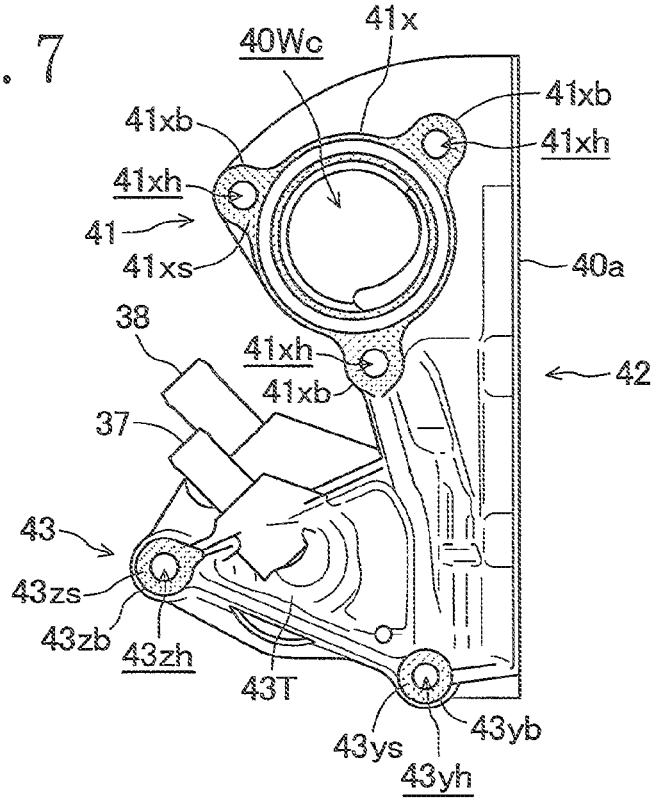
FIG. 7 is a rear view of the accessory unit bock.

The upper portion 41 of the accessory unit block 40 has a triangular shape as viewed from the front or the rear (FIG. 7). The rear surface, shown in FIG. 7, of the accessory unit block 40 has an annular attachment surface 41*xs* on an end surface of an opening 41*x* forming a cooling water supply part 40Wc. The annular attachment surface 41*xs* is adapted to confront or mate with an annular attachment surface 3*xs* (FIG. 4) formed by the annular end surface 3*x* of the cooling water inlet 3Wa, which is formed in the front side surface 3*f* of the cylinder block 3. The annular attachment surface 41*xs* is formed therearound with three circumferentially equi-distantly arranged attachment holes 41*xh* which form upper attachment parts 41*xb*. The attachment holes 41*xh* are formed to confront or mate with the three attachment holes 3*xh* of the three attachment bosses 3*xb*, respectively, on the cylinder block 3. The annular attachment surface 41*xs* has an annular groove in which a sealing ring is fitted.

The upper portion 41 of a triangular shape as viewed from the front has a vertical right side and upper and lower sides extending to the left in a converging manner from the two ends of the vertical right side to intersect each other. The three upper attachment parts 41*xb* are positioned substantially at the three apexes of the triangle.

Below the lower part of the water pump housing 43P in the lower portion 43 of the accessory unit block 40 is formed a lower attachment part 43*yb* having an attachment surface 43*ys* with a hole 43*yh*. The hole 43*yh* is adapted to confront or mate with the attachment hole 3*yh* in the attachment surface 3*ys* of the attachment boss 3*yb* on the front surface of the cylinder block 3. On the bulging end part of the thermostat housing 43T, which bulges to the left from the water pump housing 43P, is formed a lower attachment part 43*zb* with an attachment hole 43*zh*, which is adapted to confront or mate with the attachment hole 3*zh* formed in the attachment surface 3*zs* of the attachment boss 3*zb* on the cylinder block 3.

As will be understood from the above, the upper portion 41 and the lower portion 43 extend from the right side surface (attachment surface 40*a*) of the accessory unit block 40, and the middle portion 42 has a constricted shape between the upper and lower portions (See FIGS. 5 and 7).

Referring to FIG. 6, a recessed passage 40*v* extends along the attachment surface 40*a*. The recessed passage 40*v* forms a cooling water discharge passage 40Wb extending from the pump chamber 40Wa in the lower portion 43. The recessed passage 40*v* extends from an upper part of the pump chamber 40Wa, curves upward in the middle portion 42, which curves rearward toward the cylinder head 3 and then is connected to the cooling water supply part 40Wc in the upper portion 41.

As shown in FIG. 6, the attachment surface 40*a* is made up of a surface of the wall defining the pump chamber 40Wa, and a right side surface of the unit block 40, which is a wall defining the recessed passage 40*v*, i.e., the cooling water discharge passage 40Wb. The attachment surface 40*a* is provided with six cover-fixing parts 40*ab* formed with attachment holes 40*ah*, respectively.

The attachment surface 40*a* of the upper portion 41 has two of the cover-fixing parts 40*ab* at an upper position of the upper portion 41 and at a lower, rear (facing the cylinder head) position of the upper portion 41. The attachment surface 40*a* of the middle portion 42 has one of the cover-fixing parts 40*ab* at a front position of the middle portion 42. The attachment surface 40*a* of the lower portion 43 has two of the cover-fixing parts 40*ab* at upper, front and rear positions of the lower portion 43 and one of the cover-fixing parts 40*ab* at a bottom position of the lower portion 43.

Referring to FIG. 5, an upper fixing boss 41*b* for attaching an accessory (AC generator) is formed the top of the accessory unit block 40. The upper fixing boss 41*b* is provided above and adjacent to the uppermost cover-fixing part 40*ab* and the uppermost attachment part 41*xb*. The upper fixing boss 41*b* is formed with an attachment hole 41*bh* directed to the left from the attachment surface 40*a*. The attachment hole 41*bh* has an opening flush with the attachment surface 40*a*.

As shown in FIG. 5, the upper side edge 43U of the water pump housing 43P of the lower portion 43 extends slightly upward to the front with a considerable width (in the left-to-right direction), and a lower fixing boss 43*b* for fixing the accessory is formed at the free end of the forward extension.

The lower fixing boss 43*b* is positioned obliquely above and adjacent to the upper, front cover-fixing part 40*ab* of the attachment surface 40*a* belonging to the lower portion 43. The lower fixing boss 43*b* is formed with a through attachment hole 43*bh* extending from the right-side face adjacent to the attachment surface 40*a* to the left-side face of the lower fixing boss 43*b*. The right-side opening of the attachment hole 43*bh* is flush with the attachment surface 40*a*.

The thermostat housing 43T included in the lower portion 43 of the accessory unit block 40 opens toward the front, and two attachment holes 43*ah* are formed on an opening end surface 43*a* of the thermostat housing (see FIG. 5). The opening of the thermostat housing 43T is covered and closed by a thermostat cover 35.

The thermostat cover 35 has a central dome-shape part 35*d* around which a flange 35*f* is formed which is adapted to confront the opening end surface 43*a* of the thermostat housing. The flange 35*f* is formed with attachment holes 35*fh* adapted to confront or mate with the attachment holes 43*ah*. A passage or pipe 36 extends outward from the dome-shape part 35*d* of the thermostat cover 35.

A thermostat mechanism is placed in the thermostat housing 43T, and the thermostat cover 35 is applied. Then, fixing bolts 39 are inserted through the attachment holes 35*fh* and screwed into the attachment holes 43*ah*, whereby the thermostat 30 is formed. From the thermostat housing 43T connecting pipes 37 and 38 extend obliquely upward. The connecting pipes 37 and 38 are arranged side-by side in the front-to-rear direction and communicate with the interior of the thermostat housing 43T. The connecting pipe 37 is connected to the bypass passage 30*i*, while the connecting pipe 38 is connected to the passage 19*e* from the heater core 19.

Referring to FIG. 9, the thermostat 30 has a central space 30Wa occupying a major part of the interior of the thermostat housing 43, a small recessed back space 30Wb located inward of the interior of the thermostat housing 43, and a front space 30Wc located in front of the central space 30Wa. A bypass passage valve 31 openably partitions the central space 30Wa and the recessed back space 30Wb, while a radiator passage valve 32 openably partitions the central space 30Wa and the front space 30Wc. The bypass passage valve 31 and the radiator passage valve 32 are connected with each other so as to be shifted in unison. When one of these valves 31 and 32 is closed, the other is opened, and vice versa.

The bypass passage valve 31 and the radiator passage valve 32 are urged by a spring 33 in a direction toward the front to open the bypass passage valve 31 and close the radiator passage valve 32. When the wax 34 within the central space 30Wa is subjected to thermal expansion due to temperature increase of the cooling water, the wax 34 causes the bypass passage valve 31 and the radiator passage valve 32 to be shifted to the rear to close the bypass passage valve 31 and open the radiator passage valve 32.

A radiator connecting pipe 36 extends communicatively from the front space 30Wc and is connected to the passage 18*e* from the radiator. The connecting pipe 37 communicating with the rear space 30Wb is connected to the passage 30*i*, while the connecting pipe 38 communicating with the central space 30Wa is connected to the passage 19*e* from the heater core. The central space 30Wa is in communication with the pump chamber 40Wa in the water pump housing 43P.

In the cool time, therefore, the bypass passage valve 31 is opened and the radiator passage valve 32 is closed, so that the cooling water that has been circulated through the cylinder block 3 and the cylinder head 4 flows into the rear space 30Wb of the thermostat 30 through the bypass passage 30*i* without flowing through the radiator 18, the cooling water then flowing into the central space 30Wa and then into the pump chamber 40Wa to thereby warm up the engine.

In the heated time, the bypass passage valve 31 is closed and the radiator passage valve 32 is opened, so that the cooling water that has been circulated through the cylinder block 3 and the cylinder head 4 flows into the radiator 18 to be cooled thereby, the cooling water then flowing into the front space 30Wc of the thermostat 30, thereafter into the central space 30Wa and then into the pump chamber 40Wa to thereby cool down the engine 2.

The water pump cover 25 to be attached to the attachment surface 40*a* of the accessory unit block 40 is composed of a water passage forming part 26 of flat shape to be attached to the attachment surface 40*a*, and a cylindrical bearing part 27 protruding to the right from a lower portion of the water passage forming part 26 (see FIG. 5).

Figure 8:
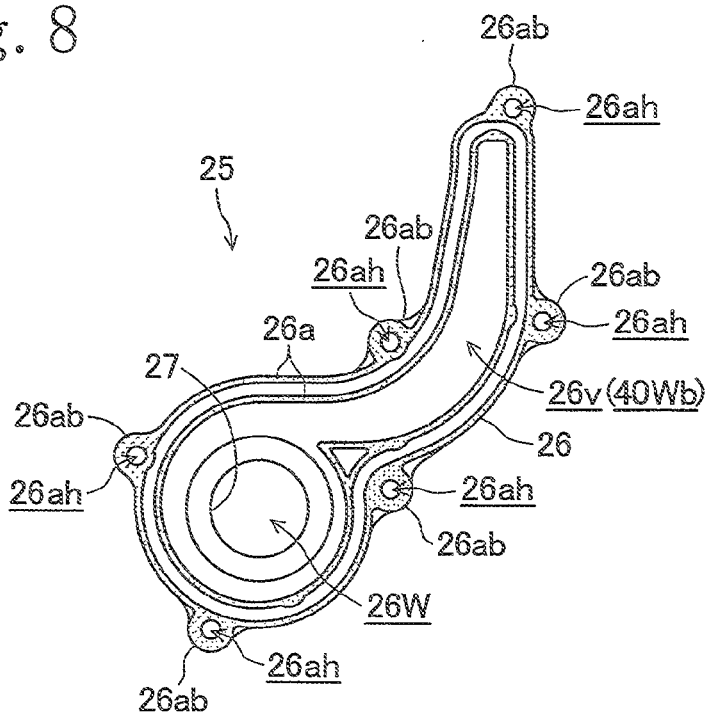
FIG. 8 is a rear view of the water pump cover.

Referring to FIG. 8, the water passage forming part 26 is formed with an attachment surface 26*a* which mates with the attachment surface 40*a* of the accessory unit block 40. The attachment surface 26*a* is formed to surround a recessed passage 26*v* identical in shape to the recessed passage 40*v* of the accessory unit block 40 and to surround a bearing hole opening 26W adapted to confront the pump chamber 40Wa. Attachment parts 26*ab* having attachment holes 26*ah*, respectively, are formed along the attachment surface 26*a*. The attachment surface 26*a* of the water passage forming part 26 is formed with a groove in which a seal member is fitted.

The attachment surface 26*a* of the water pump cover 25 is abutted in face to face contact with the attachment surface 40*a* of the unit block 40, and then bolts 29 are passed through the attachment holes 26*ah* and screwed into the attachment holes 40*ah*. Thus, the water pump cover 25 is securely fixed to the unit block 40 with the recessed passage 26*v* mating with the recessed passage 40*v* to define therebetween the cooling water discharge passage 40Wb.

Figure 10:
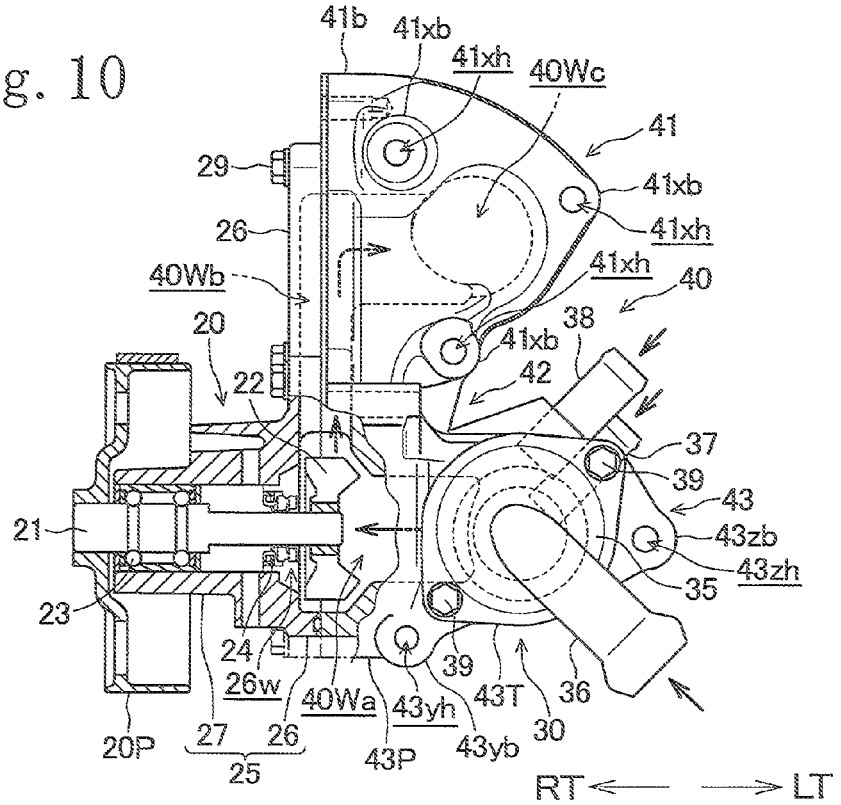
FIG. 10 is a front view, partly in section, showing a state in which a water pump and the thermostat are assembled with the accessory unit block.

As shown in FIG. 10, the cylindrical bearing part 27 rotatably supports therein a pump drive shaft 21 through a bearing 23, and impellers 22 are fixed to the left end of the pump drive shaft 21 projecting into the pump chamber 40Wa. On the right end of the pump drive shaft 21, projecting out of the cylindrical bearing part 27 is fixed a water pump pulley 20P. The right end of the cylindrical bearing part 27, facing the pump chamber 40Wa, has a bearing hole opening 26W, which is liquid-tightly sealed by a seal member 24.

In the state shown in FIG. 10 in which the water pump 20 and the thermostat 30 are fixed to the accessory unit block 40, the accessory unit block 40 is fixedly attached to the front side surface 3*f* of the cylinder block 3.

The attachment surface 41*xs*, 43*ys* and 43*zs* (FIG. 7) on the rear side of the accessory unit block 40 are abutted to the attachment surfaces 3*xs*, 3*ys* and 3*zs* (FIG. 4) on the front side surface 3*f* of the cylinder block 3. Thereafter, attachment bolts 45 are passed through the holes 41*xh* of the three upper attachment parts 41*xb* and through the holes 43*yh* and 43*zh* of the lower attachment part 43*yb* of the unit block 40 and screwed into the three upper attachment holes 3*xh* and the two lower attachment holes 3*yh* and 3*zh* of the cylinder block 3, whereby the unit block 40 is fixedly attached to the cylinder block 3.

FIG. 11 shows the state in which the accessory unit block 40 is fixedly attached to the front side surface 3*f* of the cylinder block 3. In this state, the annular attachment surface 41*xs* (FIG. 7) on the end surface of the opening 41*x* forming the cooling water supply part 40Wc of the unit block 40 is abutted against the annular attachment surface 3*xs* (FIG. 4) formed on the annular end surface 3*x* of the cooling water inlet 3Wa in the cylinder block 3, so that the cooling water supply part 40Wc of the unit block 40 is made in communication with the cooling water inlet 3Wa in the cylinder block 3.

When the internal combustion engine 2 is operated and the crankshaft 8 is rotated, the water pump pulley 20P of the water pump 20 is rotated via the endless belt 17 to rotate the pump drive shaft 21, whereby the water pump 20 is operated. Consequently, the impellers 22 fixed to the drive shaft 21 are rotated, so that the cooling water in the central space 30Wa of the thermostat 30 is caused to be sucked into the pump chamber 40Wa and discharged into the cooling water discharge passage 40Wb (See FIG. 10).

The cooling water discharged into the cooling water discharge passage 40Wb flows into the cooling water supply part 40Wc that opens in the annular attachment surface 41*xs* on the rear side of the upper portion 41 of the unit block 40. From the cooling water supply part 40Wc, the cooling water flows into the cooling water inlet 3Wa of the cylinder block 3 and is circulated in the cylinder block 3.

As indicated in FIG. 11, the AC generator 10 is mounted on the accessory unit block 40 which has thus been attached to the front side surface 3*f* of the unit block 3.

The AC generator 10 has its housing 10*c* shaped cylindrical and is fixedly mounted in the space 40E of recessed L-shape above the upper side edge 43U of the lower portion 43 of the unit block 40 and in front of the upper portion 43, with the axis (drive shaft axis) of the cylindrical shape of the housing 10*c* oriented in the left-to-right direction.

The housing 10*c* of the AC generator 10 is formed with an upper fixing bracket 11 projecting from an upper rear position on the left-side part of the housing 10*c*. The housing 10*c* is also formed with opposite lower fixing brackets 12L and 12R projecting from lower front positions on the left-side part and the right-side part of the housing 10*c*, respectively.

An attachment hole 11*h* formed in the upper fixing bracket 11 mates with the attachment hole 41*bh* in the upper fixing boss 41*b* formed on the upper part of the upper portion 41 of the accessory unit block 40. Attachment holes 12Lh and 12Rs formed in the lower fixing brackets 12L and 12R mate with an attachment hole 43*h* in the lower fixing boss 43*b*, which is formed at the end portion of the upper-side edge 43U of the water pump housing 43P forming a part of the lower portion 43 of the unit block 40.

The AC generator 10 is put in the space 40E of recessed shape like the letter L above the accessory unit block 40 in a state in which the upper fixing bracket 11 is in abutment with the right-side surface of the upper fixing boss 41*b* of the unit block 40. Then, a bolt 13 is passed from the right side through the attachment hole 11*h* in the upper fixing bracket 11 and screwed into the attachment hole 41*bh* in the upper fixing boss 41*b*, thereby to fixedly secure the AC generator.

The mutually opposed, lower fixing brackets 12L and 12R are put in such a manner that the brackets 12L and 12R are positioned on the two sides of the lower fixing boss 43*b* with the attachment holes 12Lh and 12Rh positioned coaxial with the attachment hole 43*bh* in the lower fixing boss 43*b*. Then, a bolt 14 is passed from the left side through the attachment holes 12Lh and the attachment hole 43*bh* and screwed into the attachment hole 12Rh in the lower fixing bracket 12R.

The state in which the AC generator 10 is fixedly mounted on the accessory unit block 40 is shown in the right side view of FIG. 12.

The flat-shaped upper portion 41 of the accessory unit block 40 and the upper-side edge 43U of the lower portion 43 of the unit block 40, which extends away from the cylinder block 3 (engine body), cooperate to form substantially an L-shape, which defines the recessed space 40E, and the AC generator 10 is disposed in the recessed space 40E. For this reason, the AC generator 10 can be securely mounted on the water pump 20 and the thermostat 30 forming the parts of the lower portion 43 and additionally along the upper portion 41 of the accessory unit block 40, in such a manner that the AC generator 10 is located as close as possible to the engine body 2. Thus, the AC generator as an engine accessory is disposed in a compact manner, whereby the entire volumetric size of the entire engine 2 is reduced.

Referring to FIG. 12 which is a right-side view, the upper fixing bracket 11 and the lower fixing brackets 12L and 12R of the AC generator 10 extend in radial directions with respect to a center axis C of the housing 10*c*. The angle θ formed between lines L1 and L2 is an obtuse angle, for example, 180° the line L1 being a line extending from the center axis C to the attachment hole 11*h* (the bolt 13) in the upper fixing bracket 11 and the line 12 being a line extending from the center axis C to the attachment holes 12Lh and 12Rh (the bolt 14) in the lower fixing brackets 12L and 12R.

The obtuse angle enables the housing 10*c* of the AC generator 10 to be positioned deep into the L-shaped recessed space 40E formed by the accessory unit block 40, so that the entire volumetric size of the entire engine 2 can further be reduced.

The upper fixing boss 41*b* and the lower fixing boss 43*b*, which are end portions of the L-shape formed by the upper portion 41 and the upper-side edge 43U of the lower portion 43 of the accessory unit block 40, are on the lines L1 and L2 forming an obtuse angle, which is close to 180°, and the AC generator 10 is positioned so as to connect the end portions of the L-shape. Therefore, the accessory unit block 40 itself is reinforced by the AC generator 10.

At the upper end of the upper portion 41 of the accessory unit block 40 is formed the upper fixing boss 41*b* having high rigidity and strength, while at the free end of the upper-side edge 43U of the pump housing 43P of the lower portion 43 of the accessory unit block 40 is formed the lower fixing boss 43*b* having high rigidity and strength. To such upper and lower fixing bosses 41*b* and 43*b* of high rigidity and strength are attached the upper fixing bracket 11 and the lower fixing brackets 12L and 12R of the AC generator 10. Therefore, a sufficient mounting rigidity for the support of the AC generator 10 is ensured.

The accessory unit block 40 is reinforced also by the water pump cover 25, because the water pump cover 25, which is attached to the attachment surface 40*a* extending on the rear side of the unit block 40 from the upper portion 41 to the lower portion 43 thereof, has the fixing parts 26*ab*, which are fixed to the upper cover-fixing parts 40*ab* of the attachment surface 40*a* adjacent to the upper fixing boss 41*b* of the upper portion 41 and to the lower cover-fixing parts 40*ab* of the attachment surface 40*a* adjacent to the lower fixing boss 43*b* of the lower portion 43.

The upper fixing boss 41*b* is formed adjacent to the upper cover-fixing part 40*ab*, and the lower fixing boss 43*b* is formed adjacent to the lower cover-fixing parts 40*ab*. Therefore, the rigidity and the strength of both the upper fixing boss 41*b* and the lower fixing boss 43*b* are increased, and consequently the support strength for the AC generator is further increased.

The cooling water discharge passage 40Wb is formed along the attachment surface 40*a* for the water pump cover 25, which attachment surface 40*a* extends from the upper portion 41 through the middle portion 42 to the lower portion 43 of the accessory unit block 40. This makes it easy to work and form the cooling water flow passage.

The cooling water discharge passage 40Wb is formed through the middle portion 42 of curved shape, whereby hydraulic flow loss in the passage can be suppressed. Further, the AC generator is mounted in a manner to stretch a chord between the two ends of an arc. Therefore, a required strength for the cooling water discharge passage 40Wb can be maintained even in case the parts around the discharge passage 40Wb are not made sophisticated, whereby the accessory unit block 40 and the water pump cover 25 can be made compact and of light weight.

The water pump 20 incorporated in the accessory unit block 40 is driven by the water pump pulley 20*p* through the endless belt 17, but the water pump could be driven by an electric motor.

What is claimed is:

1. An accessory mounting structure for an internal combustion engine comprising a body having two ends and a side, and an accessory unit block supporting an engine accessory, the accessory unit block being detachably attached to the planar side surface of the body of the internal combustion engine, the side surface extending along a crankshaft of the engine:

wherein the accessory unit block comprises:

an upper portion having a flat shape extending along the side surface of the engine body and including a cooling water supply part communicating with a cooling water inlet in the engine body;

a middle portion extending in a curved shape from a lower part of the upper portion to protrude in a direction away from and perpendicular to the side surface of the engine body, and a lower portion extending downward from the middle portion and further away from the engine body and disposed more remote from the side surface of the engine body than the middle portion, in such a manner that the lower portion is offset relative to the upper portion to protrude in a direction further away from and perpendicular to the side surface of the engine body, the lower portion integrally having a water pump housing defining a pump chamber and a thermostat housing enclosing a thermostat;

wherein the upper portion, the middle portion and the lower portion are shaped to form an L-shaped recessed space in which the engine accessory is accommodated, said L-shaped recessed space having opposite arms, one of the arms extending out of the planar side surface of the body of the engine;

wherein the accessory unit block is formed therein with a cooling water discharge passage extending from the pump chamber in the water pump housing through the curved middle portion and the upper portion into the cooling water supply part of the accessory unit block, and the accessory unit block includes an upper fixing boss formed on an upper end part of the upper portion of the unit block, an upper-side edge extending in a direction away from and perpendicular to the planar side surface of the engine body on an upper side of the water pump housing of the lower portion, and a lower fixing boss formed on a remote end of the upper-side edge of the water pump housing; and wherein the engine accessory is formed with fixing brackets attached and fixed to the upper and lower fixing bosses of the unit block, respectively, and the engine accessory is fixedly mounted on the unit block by means of the fixing brackets.

2. The accessory mounting structure for an internal combustion engine according to claim 1, wherein:

the accessory unit block includes a first attachment surface attached to the side of the engine body, and a second attachment surface extending from the upper portion to the lower portion of the unit block and extending perpendicular to the first attachment surface, a water pump cover is attached to the second attachment surface, the water pump housing has an opening formed in the second attachment surface belonging to the lower portion, and a water pump is assembled with the accessory unit block to cover the opening of the water pump housing.

3. The accessory mounting structure for an internal combustion engine according to claim 2, wherein:

the upper portion of the unit block includes cover-fixing parts formed on the second attachment surface adjacent to the upper fixing boss, the lower portion of the unit block includes cover-fixing parts formed on the second attachment surface adjacent to the lower fixing boss, the water pump cover is formed with attachment parts, and the water pump cover is attached to the unit block by fixing the attachment parts of the water pump cover to the cover-fixing parts of the upper and lower portions.

4. The accessory mounting structure for an internal combustion engine according to claim 2, wherein:

the cooling water discharge passage is defined by a recessed passage formed in the unit block along the second attachment surface extending from the upper portion to the lower portion through the middle portion.

5. The accessory mounting structure for an internal combustion engine according to claim 1, wherein:

a line passing through the upper fixing boss and the center of the engine accessory and a line passing through the lower fixing boss and the center of the engine accessory cross at an obtuse angle.

6. The accessory mounting structure for an internal combustion engine according to claim 1, wherein the upper fixing boss and the lower fixing boss are positioned at extreme ends of the L-shaped recessed space, respectively.

7. The accessory mounting structure for an internal combustion engine according to claim 1, wherein the upper fixing boss is positioned on an extension of a water flow line from the cooling water discharge passage to the cooling water supply part.

* * * * *